United States Patent [19]

Schuierer

[11] Patent Number: 4,841,605

[45] Date of Patent: Jun. 27, 1989

[54] METHOD AND APPARATUS FOR STRETCHING TUBULAR MATERIAL

[75] Inventor: Manfred Schuierer, Michelstadt, Fed. Rep. of Germany

[73] Assignee: Bruckner Apparatebau GmbH, Fed. Rep. of Germany

[21] Appl. No.: 764,192

[22] Filed: Aug. 9, 1985

[30] Foreign Application Priority Data

Sep. 13, 1984 [DE] Fed. Rep. of Germany ..... 3433701

[51] Int. Cl.[4] ..... D06C 5/00

[52] U.S. Cl. ..... 26/74; 26/80; 68/13 R

[58] Field of Search ..... 26/74, 75, 80, 81, 83, 26/84, 85; 68/13 R

[56] References Cited

U.S. PATENT DOCUMENTS

| | | | |
|---|---|---|---|
| 3,508,286 | 4/1970 | Rosen | 26/80 R |
| 3,958,432 | 5/1976 | Aronoff | 68/13 R |
| 4,017,722 | 4/1977 | Swanson | 26/51.5 X |
| 4,182,140 | 1/1980 | Sando et al. | 68/13 X |
| 4,266,983 | 5/1981 | Laszlo et al. | 26/81 X |
| 4,322,957 | 4/1982 | Nowicki et al. | 26/81 X |

FOREIGN PATENT DOCUMENTS

| | | | |
|---|---|---|---|
| 3029331 | 2/1982 | Fed. Rep. of Germany | 68/13 R |
| 59-15554 | 1/1984 | Japan | 68/13 R |
| 2039966 | 8/1980 | United Kingdom | 68/13 R |

OTHER PUBLICATIONS

Lindner, Siegfried, "New Airtex Unit Speeds Finishing", Knitting Times, vol. 48, No. 29, Jul. 9, 1979, pp. 14, 15.

*Primary Examiner*—Robert R. Mackey
*Attorney, Agent, or Firm*—Sheldon & Mak

[57] ABSTRACT

The invention relates to a method and to apparatus for stretching tubular material by blowing in compressed air, in which the delivery speed and/or the removal speed of the tubular material are regulated. In this way, a very uniform stretching of the tubular material is achieved without impairing the surface.

4 Claims, 1 Drawing Sheet

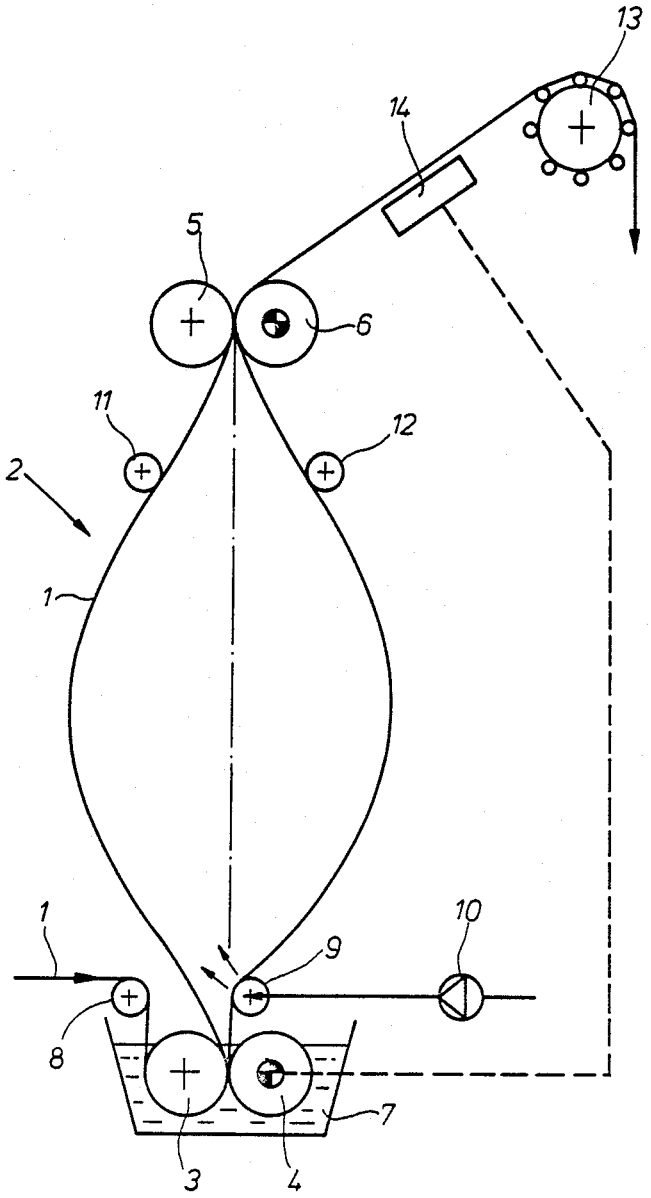
13
14
5
6
11
12
2
1
1
10
9
8
7
3
4

METHOD AND APPARATUS FOR STRETCHING TUBULAR MATERIAL

BACKGROUND OF THE INVENTION

1. Field of the Invention

The invention relates to a method of stretching continuously moving tubular fabric in a wet state and to apparatus for carrying out the method.

2. Description of the Related Art

In order to improve the dimensional stability of tubular textile material, it is known for the textile material to be stretched in the wet state and then to be dried. Until now, this stretching of the tubular material has been carried out with the aid of mechanical stretching means (width holders) in which the tubular material is gripped in its edge region and is stretched widthways by gradual moving apart of the two gripping zones.

The principal disadvantage of this method is that the tubular material is considerably more stretched in the immediate proximity of the gripped edge region by the greater traction exerted there than in the central region between the gripped zones. Thus, in this known method, the tubular material is stretched unevenly, so that optimum improvement of the dimensional stability is not achieved.

For another purpose, namely for laying textile material in rope or tubular form during wet treatment (such as dyeing, washing, rinsing), it is also known to blow air into the tubular material in order to open out the creases which have formed (U.S. Pat. No. 4,318,209). However, no expansion forces are exerted on the material beyond the simple opening out of the tube.

SUMMARY OF THE INVENTION

The object of the invention is to make further developments to a method of the type set out in the Field of the Invention in such a way that uniform stretching of the tubular material over its whole width is achieved without any mechanical action impairing the surface of the material.

This object is achieved according to the invention.

In the method according to the invention, the tubular material is introduced into the stretching zone with a lead. With a delivery speed higher than the removal speed, a greater length of tubular material is therefore introduced into the stretching zone than is removed. In addition, compressed air (in sufficient quantity and under sufficient pressure) is sprayed into the stretching zone, and the tubular material is sealed at the beginning and at the end of the stretching zone against the escape of air.

In the tests on which the invention is based, it was found that the extent of the stretching of the tubular material can be influenced very sensitively and accurately by regulating the delivery speed and/or the removal speed. If the width of the tubular material is measured after the stretching zone, then by regulation of the delivery and/or removal speed, the tubular material can be stretched accurately to the desired width. In contrast to the previously known mechanical method of stretching, in the pneumatic stretching method according to the invention, an absolutely uniform stretching of the tubular material over the whole width is achieved, since the same expansion forces act on all peripheral points and no zones of the tubular material are gripped.

BRIEF DESCRIPTION OF THE DRAWING

The drawing is a schematic view of an apparatus for practicing the invention.

DESCRIPTION OF THE PREFERRED EMBODIMENT

The schematically represented apparatus serves for stretching tubular material 1 in a stretching zone 2, the beginning and end of which are each defined by a pair of rollers 3, 4 and 5, 6 respectively. One roller of each pair, namely the rollers 4 and 6 respectively, is driven. In addition, the speed of rotation of the roller 4 of the pair of rollers provided at the beginning of the stretching zone is regulable.

The rollers 3 and 4 are arranged in a fluid tank 7 which is preferably filled with water and into which the tubular material 1 is led over a guide roller 8.

For spraying compressed air into the tubular material 1, a nozzle element 9 which butts against the outside of the tubular material 1 is provided at the beginning of the stretching zone 2, is supplied with compressed air by a pump 10 and contains at least one nozzle opening (not shown). The nozzle element 9 can either be arranged stationary or can run freely with the tubular material. In the latter case the openings of the nozzle element 9 which are not covered by the tubular material can either be sealed by a stationary seal or (accepting a certain loss of compressed air) can remain open.

Two guide rollers 11, 12 are arranged some distance before the rollers 5 and 6 located at the end of the stretching zone and cause the inflated tubular material 1 to run into the pair of rollers 5, 6 at a defined aperture angle which is not too great. In this way, the formation of creases in the tubular material 1 as it passes the pair of rollers 5, 6 is prevented.

After leaving the stretching zone 2, the tubular material 1 passes a reel 13, for example. The tubular material 1 is led between the pair of rollers 5, 6 and the reel 13 in a flat (planar) state and passes a measuring arrangement 14 which measures the width of the tubular material 1 which was stretched in the stretching zone 2 and is now in two layers.

The method according to the invention can be carried out using the illustrated apparatus, for example, in such a way that the roller 6 which removes the tubular material 1 from the stretching zone 2 is driven at a fixed speed so that the tubular material leaves the stretching zone at a predetermined removal speed. By contrast, the roller 4 which is provided at the beginning of the stretching zone 2 is driven as a function of the signal from the measuring arrangement 14 at such a speed that the tubular material 1 runs into the stretching zone 2 at a delivery speed which is higher than the removal speed. Furthermore, if compressed air is sprayed into the tubular material in sufficient quantity and at sufficient pressure through the nozzle element 9, then by regulating the drive speed of the roller 4 it is possible for the degree of stretching of the tubular material 1 taking place in the stretching zone 2 to be influenced very sensitively and accurately (and with quite a small delay in response). If the delivery speed is increased, then the stretching becomes greater, and the reverse applies. In the stretching zone 2 the fluid applied to the tubular material 1 in the fluid tank 7 seals the interior of the tubular material 1 against an escape of air. In addition, at the beginning and at the end of the stretching zone 2, the rollers 3, 4 and 5, 6 effect the necessary sealing of the stretching zone.

The following example should serve for further explanation of the invention. A tubular knit fine-ribbed cotton material comes as raw material for finishing with a tube width of 36 cm. The desired tube width of the finished material is 30 cm.

The material is treated in a bleaching plant, then rinsed, and then because of the longitudinal stretching has a tube width of 25 cm.

This material runs at 20 m/min into the gap formed by the rollers 3 and 4. The fluid level in the tank 7 is chosen so that the material coming out of the gap can in turn be fully wetted with water.

Air is passed to the wet fluid-covered tubular material by the pump 10 at a pressure approximately 1000 mm of water via a stationary pipe which is provided with a bore of 3 mm. In this way, the tubular material is filled with air. The rollers 11 and 12 ensure that the tubular material reaches the gap formed by the rollers 5 and 6 without distortion of the curvature. The pair of rollers formed by the rollers 5 and 6 run at a speed of 17 m/min. This results in a speed differential between the two pairs of transport rollers of 15%.

The material is squeezed hard between the rollers 5 and 6 so that it has a minimal water content, for example 70%. The material passes the measuring arrangement 14 with a tube width of 31 cm. In the subsequent drying, the material shrinks a little more lengthways and widthways so that the desired finished width of 30 cm is achieved and the length of material has low residual shrinkage values.

I claim:

1. A method of laterally stretching continuously moving tubular fabric, comprising the steps of delivering the fabric in a wet state to a stretching zone, removing the fabric from the stretching zone, the linear speed at which the fabric is delivered to the stretching zone being greater than the linear speed at which the fabric is removed from the stretching zone, injecting compressed air to inflate and stretch the tubular fabric in the stretching zone, sealing the inflated tubular fabric against escape of air during delivery of the fabric to and during removal of the fabric from the stretching zone, deflating the stretched tubular fabric leaving the stretching zone and measuring the width of the deflated stretched tubular fabric, and maintaining such width at a predetermined value by using the measurement of such width to control the excess of the linear speed at which the fabric is delivered to the stretching zone over the linear speed at which the fabric is removed from the stretching zone.

2. Apparatus for laterally stretching continuously moving wet tubular fabric, comprising a first pair and a second pair of continuously driven rollers through which the tubular fabric passes in succession, means for injecting compressed air to inflate and stretch the tubular fabric between the two pairs of rollers while the two pairs of rollers seal the inflated tubular fabric against escape of air, and means for measuring the width of the flattened stretched tubular fabric leaving the second pair of rollers, said measuring means being connected to control the speed of at least one of the pairs of rollers to maintain such an excess of the peripheral speed of the first pair of rollers over the peripheral speed of the second pair of rollers as to maintain the measured width at a predetermined value.

3. Apparatus as claimed in claim 2 wherein the rollers of the first pair are arranged in a tank of fluid to cause the tubular fabric emerging from the fluid to be coated with a film of the fluid.

4. Apparatus as claimed in claim 2 wherein two spaced guide rollers are so located as to bear upon the inflated tubular fabric and to cause the inflated fabric to run into the second pair of continuously driven rollers at a predetermined aperture angle.

* * * * *